US010232991B2

(12) United States Patent
Gemmill

(10) Patent No.: US 10,232,991 B2
(45) Date of Patent: Mar. 19, 2019

(54) BEVERAGE HOLDER CONTAINER CAP

(71) Applicant: Ben Gemmill, Springfield, MO (US)

(72) Inventor: Ben Gemmill, Springfield, MO (US)

( * ) Notice: Subject to any disclaimer, the term of this patent is extended or adjusted under 35 U.S.C. 154(b) by 71 days.

(21) Appl. No.: 15/499,932

(22) Filed: Apr. 28, 2017

(65) Prior Publication Data

US 2018/0312310 A1 Nov. 1, 2018

(51) Int. Cl.

| | |
|---|---|
| ***B65D 25/22*** | (2006.01) |
| ***B65D 51/24*** | (2006.01) |
| ***B65D 51/00*** | (2006.01) |
| ***A47G 23/02*** | (2006.01) |
| ***B65D 43/16*** | (2006.01) |

(52) U.S. Cl.

CPC ..... *B65D 51/007* (2013.01); *A47G 23/0241* (2013.01); *A47G 23/0266* (2013.01); *B65D 43/16* (2013.01); *B65D 51/245* (2013.01); *A47G 2023/0275* (2013.01)

(58) Field of Classification Search

CPC ..... A47G 23/0241; A47G 23/0266; A47G 2023/0275; B65D 51/007; B65D 43/16; B65D 51/245

USPC ..... 220/729, 739, 740

See application file for complete search history.

(56) References Cited

U.S. PATENT DOCUMENTS 1,502,242 A * 7/1924 French ..... A47G 23/0241 215/396
2,689,760 A * 9/1954 Vanous ..... A47G 23/0266 294/29
3,107,029 A * 10/1963 Rylander ..... A47G 23/0266 215/396
4,872,577 A * 10/1989 Smith ..... B65D 51/04 220/739
5,199,597 A * 4/1993 Gladish ..... A47G 19/12 220/254.9
5,740,940 A * 4/1998 Weiss ..... B65D 81/3886 220/326
5,944,238 A * 8/1999 Stark ..... A45F 5/02 220/287
6,244,461 B1 * 6/2001 Roberts ..... A47G 23/0233 220/740
6,860,399 B2 * 3/2005 Reeves ..... B65D 43/162 220/739
8,485,388 B2 * 7/2013 Tuan ..... A47G 19/12 206/218
2010/0288769 A1 * 11/2010 Cheng ..... B65D 43/0202 220/259.4

(Continued)

*Primary Examiner* — J. Gregory Pickett
*Assistant Examiner* — Niki M Eloshway
(74) *Attorney, Agent, or Firm* — The Iwashko Law Firm, PLLC; Lev Ivan Gabriel Iwashko

(57) ABSTRACT

A beverage holder container cap that protects the top of a beverage protected by a beverage container holder. The beverage holder container cap includes a planar hinged cap adapted to cover a top portion of a beverage container holder, a first planar vertical stem extending downward at a 90-degree angle from the planar hinged cap and a hinge attached to an end off the first planar vertical stem to allow the planar hinged cap to be adapted to cover a top portion of a beverage container holder. The beverage holder container cap also includes a second vertical stem extending downward and adapted to align vertically with the first planar vertical stem and a planar attachment lip extending horizontally from a top end of the second vertical stem.

19 Claims, 3 Drawing Sheets

(56) References Cited

U.S. PATENT DOCUMENTS

2014/0231442 A1* 8/2014 Hill ..... A47G 19/2266
220/740
2016/0091244 A1* 3/2016 Revelis ..... F25D 31/007
62/457.9

* cited by examiner

BEVERAGE HOLDER CONTAINER CAP

BACKGROUND OF THE INVENTION

Field of the Invention

The present invention is a cap. More specifically, the present invention is a beverage holder container cap.

Description of the Related Art

Koozies or beverage container holders are a common accessory used to maintain the temperature of a canned or bottled beverage. Although, they help to ensure a drink stays cool, their design leaves the top of the drink unprotected and vulnerable to spilling accidents. The beverage holder container cap introduces a simple attachment for traditional beverage container holders that covers the top of all beverages protected by the beverage container holders.

What is needed is a beverage holder container cap that protects the top of a beverage protected by a beverage container holder.

SUMMARY OF THE INVENTION

The present invention is a cap. More specifically, the present invention is a beverage holder container cap.

The beverage holder container cap includes a planar hinged cap covering a top portion of a beverage container holder, a first planar vertical stem extending downward at a 90-degree angle from the planar hinged cap and a hinge attached to an end off the first planar vertical stem to allow the planar hinged cap to cover a top portion of a beverage container holder. The beverage holder container cap also includes a second vertical stem extending downward and aligned vertically with the first planar vertical stem and a planar attachment lip extending horizontally from a top end of the second vertical stem.

It is an object of the present invention to provide a beverage holder container cap that offers a full covered top that quickly attaches to a standard beverage container holder.

It is an object of the present invention to provide a beverage holder container cap that has a white top surface so individuals may write their name on each beverage container holder.

It is an object of the present invention to provide a beverage holder container cap that lends itself to great marketing potential as companies and/or sporting franchises may easily place their logos and name on the beverage holder container cap thereby expanding consumers outreach and notoriety.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention, however the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1:
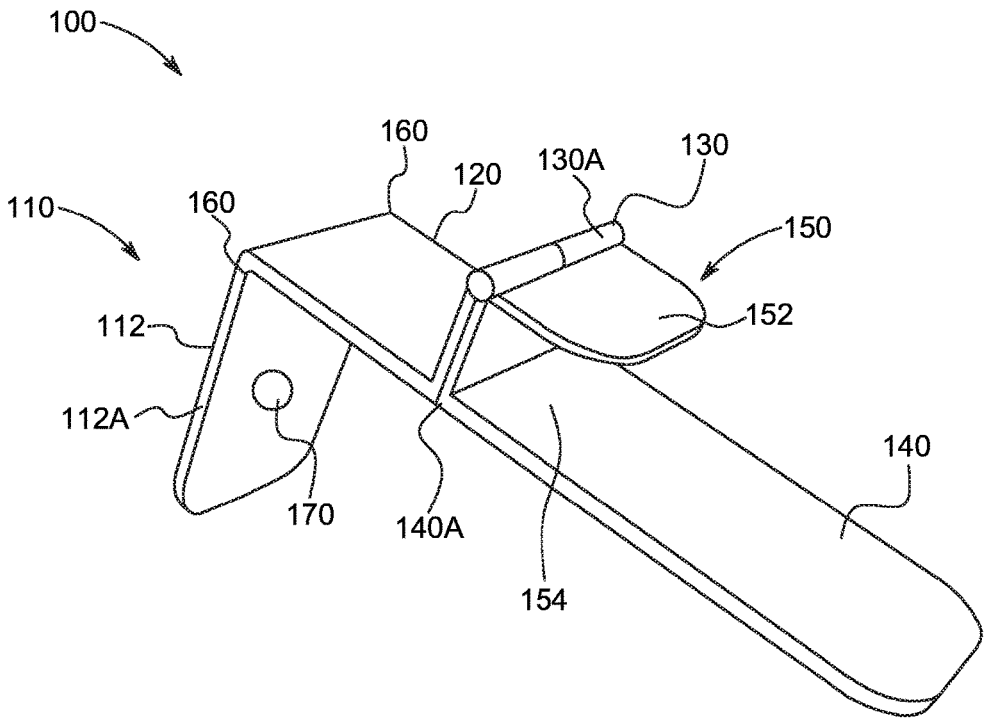
FIG. 1 illustrates a side perspective view of a beverage holder container cap, in accordance with one embodiment of the present invention.
Figure 1:
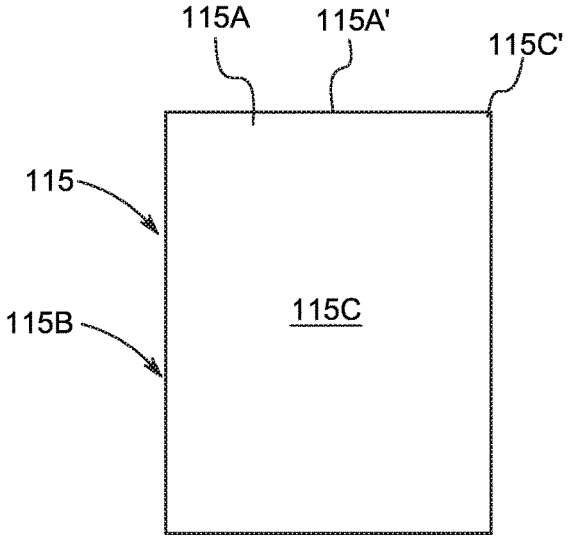

FIG. 1 illustrates a beverage holder container cap 100, in accordance with one embodiment of the present invention.

The beverage holder container cap 100 may include a planar hinged cap 110, a first planar vertical stem 120, a hinge 130, a second vertical stem 140 and a planar attachment lip 150.

The planar hinged cap 110 may be adapted to cover a top portion 115A of a beverage container holder 115. The beverage container holder 115 may be an insulated beverage container holder or KOOZIE® 115B or other suitable beverage container holder. The planar hinged cap 110 may include a functional indicia 112 such as an advertisement 112A to promote sales of a specific product or service. The planar hinged cap 110 may be made of polymer foam insulation such as polyisocyanate or other suitable insulation that matches an insulation from the beverage container holder 115. The first planar vertical stem 120 may extend downward at an approximate 90-degree angle from the planar hinged cap 110 and then extends horizontally at an approximate 90-degree angle. The first planar vertical stem 120 may be made of copper or other suitable material. The hinge 130 may be attached to an end 130A of the first planar vertical stem 120 to allow the planar hinged cap 110 to be adapted to cover the top portion 115A of a beverage container holder 115 to keep a beverage contained in the beverage container 115C cold or warm, to prevent insects and objects from going into the beverage container 115C and to reduce any spillage from the beverage container 115C. The hinge 130 may be made of plastic or metal and may be approximately 0.075 inch in diameter. The second vertical stem 140 may extend downward and be aligned vertically with the first planar vertical stem 120. The second vertical stem 140 may be made of copper or other suitable material. The planar attachment lip 150 may extend horizontally from a top end 140A of the second vertical stem 140 and extend approximately 90 degrees downward as a rounded tab 152, thereby creating a squared lip 154 to be adapted to receive an edge 115C' of the beverage container 115C to couple the beverage holder container cap 100 to the beverage container 115C. The hinge 130 may be attached to the planar attachment lip 150 to allow the planar hinged cap 110 to be adapted to cover the top portion 115A of the beverage container holder 115. The planar attachment lip 150 may be made of copper or other suitable material.

The beverage holder container cap 100 may include a pair of gussets 160 and a snap tab aperture 170. The pair of gussets 160 may be disposed in a corner portion 120A of the approximate 90-degree angle from the planar hinged cap 110 to securely fit against the beverage container holder 115 or to reinforcement the approximate 90-degree angle from the planar hinged cap 110. The snap tab aperture 170 may be disposed on a top interior side 120B of the first planar vertical stem 120. The snap tab aperture 170 may be adapted to receive a snap tab (FIG. 2, 172) disposed on a centered top portion 115A' of the beverage container holder 115.

Figure 2:
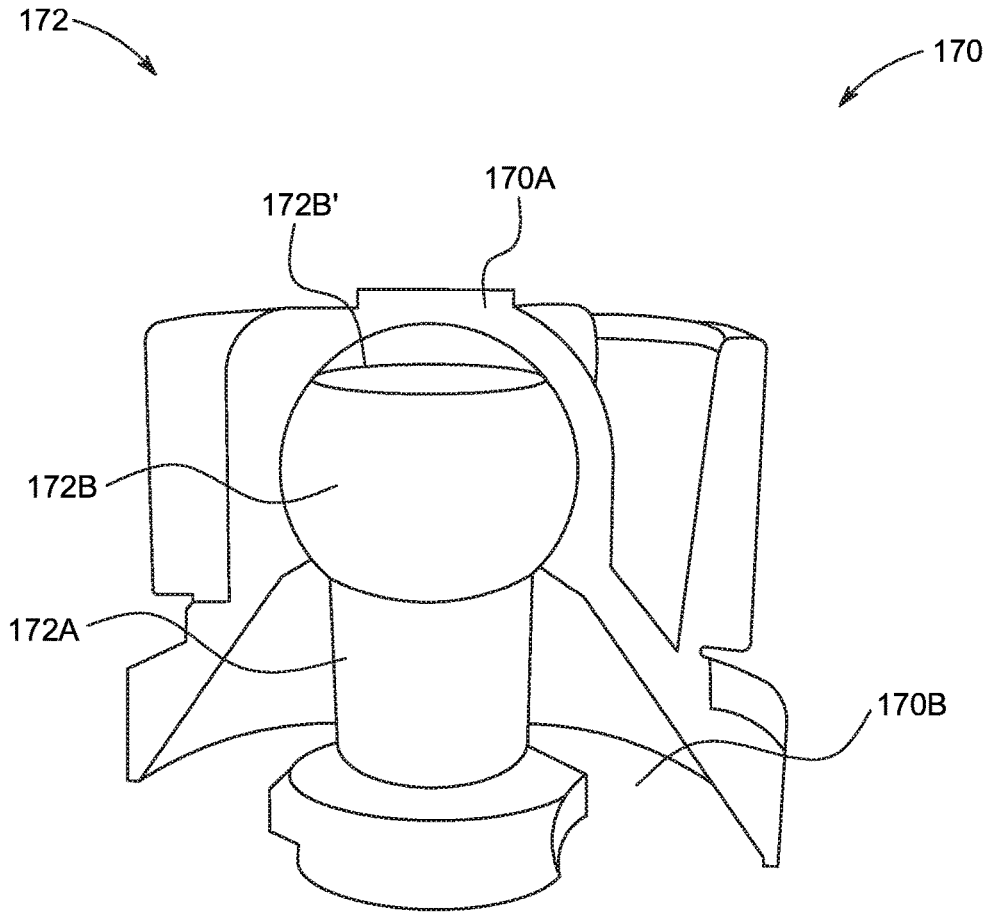
FIG. 2 illustrates a side perspective view of a snap tab, in accordance with one embodiment of the present invention.

FIG. 2 illustrates a side perspective view of a snap tab 172, in accordance with one embodiment of the present invention.

The snap tab 172 may be adapted to be aligned with the snap tab aperture 170. The snap tab 172 may have a vertical stem portion 172A and a rounded bulb portion 172B. The rounded bulb portion 172B may be disposed on top of the vertical stem portion 172A of the snap tab 172. The rounded bulb portion 1728 may have a hardened tip 172B' disposed on top to facilitate receiving the snap tab aperture 170.

The snap tab aperture 170 may include a rounded portion 170A and a tapered opening 170B. The rounded portion 170A may be fitted and adapted to receive the rounded bulb portion 172B of the snap tab 172 to prevent the rounded bulb portion 172B from wiggling within the rounded portion 170A of the snap tab aperture 170. The tapered opening 170B may facilitate the snap tab 172 to be adapted to insert into the snap tab aperture 170.

Figure 3:
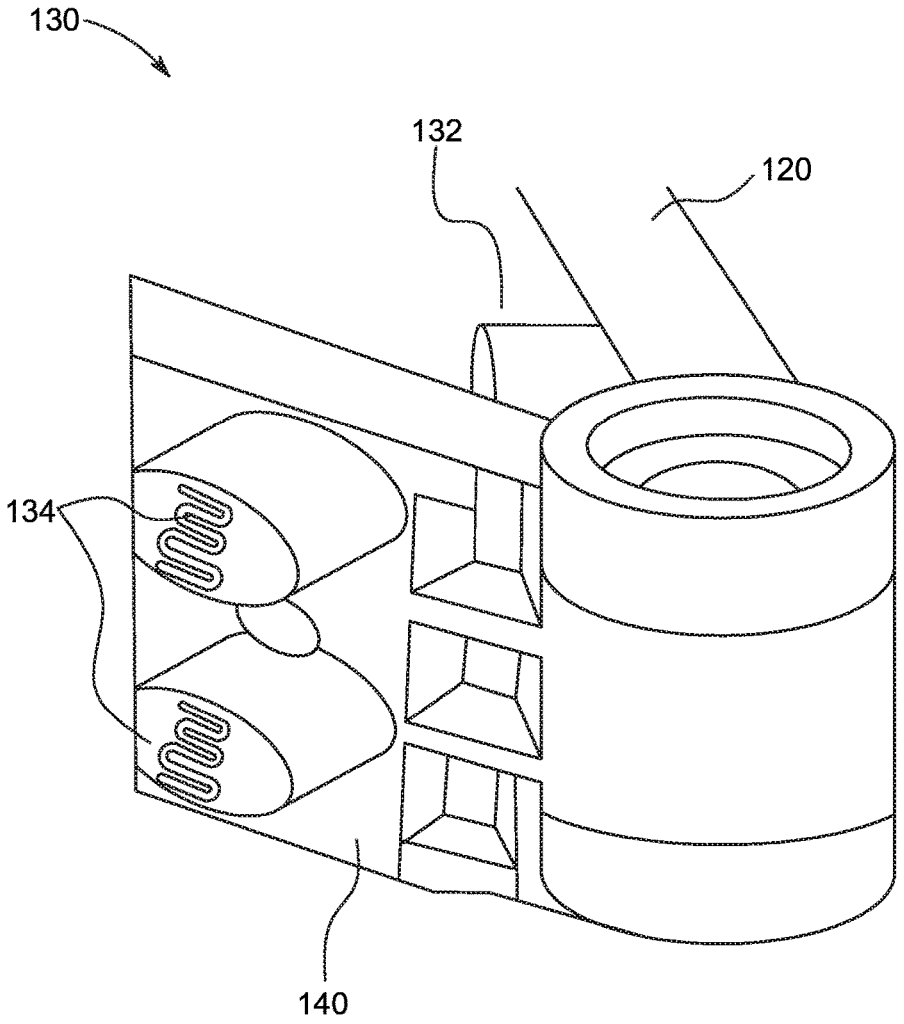
FIG. 3 illustrates a side perspective view of a hinge, in accordance with one embodiment of the present invention.

FIG. 3 illustrates a side perspective view of a hinge 130, in accordance with one embodiment of the present invention.

The hinge 130 may have a pair of securing tabs 132 disposed on the first planar vertical stem 120. The pair of securing tabs 132 may be adapted to be snapped into a pair of corresponding enclosed apertures 134 to secure the first planar vertical stem 120 against the second vertical stem 140.

The beverage holder container cap enables a person to have a closed insulation accessory for their personal drink. The beverage holder container cap restrictive hinge design permits the drinking person to drink without the top moving and/or hitting them in the face in addition to other benefits such as, serving to keep beverages colder for a longer period of time for the insulating top reduces conduction loss, minimizing insects from coming in contact with the beverage when left unattended and decreasing the loss of beverage should the drink be dropped or knocked over. The beverage holder container cap may easily become an essential accessory for use at parties and diverse outdoor events while specifically catering to fisherman campers, boaters and anyone that enjoys using an insulating cup while drinking on the go.

While the present invention has been related in terms of the foregoing embodiments those skilled in the art will recognize that the invention is not limited to the embodiments described. The present invention may be practiced with modification and alteration within the spirit and scope of the appended claims. Thus, the description is to be regarded as illustrative instead of restrictive on the present invention.

What is claimed is:

1. A beverage holder container cap, comprising:

a planar hinged cap adapted to cover a top portion of a beverage container holder;

a first planar vertical stem extending downward at a 90-degree angle from the planar hinged cap and then extends horizontally at a 90-degree angle;

a hinge attached to an end off the first planar vertical stem to allow the planar hinged cap adapted to cover a top portion of a beverage container holder to keep a beverage contained in the beverage container cold or warm, to prevent insects and objects from going into the beverage container and to reduce any spillage from the beverage container;

a second vertical stem extending downward and aligned vertically with the first planar vertical stem;

a planar attachment lip extending horizontally from a top end of the second vertical stem and extend 90-degrees downward as a rounded tab, thereby creating a squared lip to be adapted to receive an edge of the beverage container to couple the beverage holder container cap to the beverage container, the hinge is attached to the planar attachment lip to allow the planar hinged cap to be adapted to cover the top portion of the beverage container holder; and a pair of gussets disposed in a corner portion of a 90-degree angle from the planar hinged cap to secure a fit against the beverage container holder.

2. The beverage holder container cap according to claim 1, wherein the beverage container holder is an insulated beverage container holder.

3. The beverage holder container cap according to claim 1, wherein the planar hinged cap includes a functional indicia.

4. The beverage holder container cap according to claim 3, wherein the functional indicia is an advertisement to promote sales of a specific product or service.

5. The beverage holder container cap according to claim 1, wherein the 90-degree angle is reinforced by the pair of gussets.

6. The beverage holder container cap according to claim 1, wherein the planar hinged cap is made of polymer foam insulation.

7. The beverage holder container cap according to claim 6, wherein the polymer foam insulation matches insulation from the beverage container holder.

8. The beverage holder container cap according to claim 1, wherein the first planar vertical stem is made of copper.

9. The beverage holder container cap according to claim 1, wherein the hinge is made of plastic.

10. The beverage holder container cap according to claim 1, wherein the hinge is made of metal.

11. The beverage holder container cap according to claim 1, wherein the hinge is 0.075 inch in diameter.

12. The beverage holder container cap according to claim 1, wherein the second vertical stem and the planar attachment lip are made of copper.

13. A beverage holder container cap, comprising:

a planar hinged cap adapted to cover a top portion of a beverage container holder;

a first planar vertical stem extending downward at a 90-degree angle from the planar hinged cap and then extends horizontally at a 90-degree angle;

a hinge attached to an end off the first planar vertical stem to allow the planar hinged cap adapted to cover a top portion of a beverage container holder to keep a beverage contained in the beverage container cold or warm, to prevent insects and objects from going into the beverage container and to reduce any spillage from the beverage container;

a second vertical stem extending downward and aligned vertically with the first planar vertical stem;

a planar attachment lip extending horizontally from a top end of the second vertical stem and extend 90-degrees downward as a rounded tab, thereby creating a squared lip to be adapted to receive an edge of the beverage container to couple the beverage holder container cap to the beverage container, the hinge is attached to the planar attachment lip to allow the planar hinged cap to be adapted to cover the top portion of the beverage container holder; and a snap tab aperture disposed on a top interior side of the first planar vertical stem.

14. The beverage holder container cap according to claim 13, wherein the snap tab aperture is adapted to receive a snap tab disposed on a centered top portion of the beverage container holder.

15. The beverage holder container cap according to claim 14, wherein the snap tab has a vertical stem portion and a rounded bulb portion.

16. The beverage holder, container cap according to claim 15, wherein the rounded bulb portion is disposed on top of the vertical stem portion of the snap tab and is adapted to receive the rounded bulb portion of the snap tab to prevent the rounded bulb portion from wiggling within the rounded portion of the snap tab aperture.

17. The beverage holder container cap according to claim 16, wherein the rounded bulb portion has a hardened tip disposed on top of the rounded bulb portion to facilitate receiving the snap tab aperture.

18. The beverage holder container cap according to claim 14, wherein the snap tab aperture includes a tapered opening that facilitates the snap tab to be adapted to insert into the snap tab aperture.

19. A beverage holder container cap, comprising:

a planar hinged cap adapted to cover a top portion of a beverage container holder;

a first planar vertical stem extending downward at a 90-degree angle from the planar hinged cap and then extends horizontally at a 90-degree angle;

a hinge attached to an end off the first planar vertical stem to allow the planar hinged cap adapted to cover a top portion of a beverage container holder to keep a beverage contained in the beverage container cold or warm, to prevent insects and objects from going into the beverage container and to reduce any spillage from the beverage container, such that the hinge has a pair of securing tabs disposed on the first planar vertical stem that are adapted to be snapped into a pair of corresponding enclosed apertures to secure the first planar vertical stem against the second vertical stem;

a second vertical stem extending downward and aligned vertically with the first planar vertical stem; and a planar attachment lip extending horizontally from a top end of the second vertical stem and extend 90-degrees downward as a rounded tab, thereby creating a squared lip to be adapted to receive an edge of the beverage container to couple the beverage holder container cap to the beverage container, the hinge is attached to the planar attachment lip to allow the planar hinged cap to be adapted to cover the top portion of the beverage container holder.

* * * * *